US009809912B2

(12) United States Patent
McKinney et al.

(10) Patent No.: US 9,809,912 B2
(45) Date of Patent: Nov. 7, 2017

(54) VIBRATION REDUCTION MECHANISM FOR A SEWING MACHINE

(71) Applicant: HANDI QUILTER, INC., North Salt Lake, UT (US)

(72) Inventors: James Adelbert McKinney, American Fork, UT (US); Bryan K. Ruggles, Riverton, UT (US); Gary James Konzak, Salem, UT (US)

(73) Assignee: Handi Quilter, Inc., North Salt Lake, UT (US)

( * ) Notice: Subject to any disclaimer, the term of this patent is extended or adjusted under 35 U.S.C. 154(b) by 493 days.

(21) Appl. No.: 14/516,053

(22) Filed: Oct. 16, 2014

(65) Prior Publication Data

US 2016/0108572 A1 Apr. 21, 2016

(51) Int. Cl.
*D05B 69/32* (2006.01)
*D05B 11/00* (2006.01)

(52) U.S. Cl.
CPC ..... *D05B 69/32* (2013.01); *D05B 11/00* (2013.01)

(58) Field of Classification Search
USPC ..... 112/117, 220, 221, 80.42
See application file for complete search history.

(56) References Cited

U.S. PATENT DOCUMENTS 1,020,057 A * 3/1912 Ringe ..... 112/221
2,694,375 A * 11/1954 Attwood ..... 112/260
2,741,198 A * 4/1956 Attwood et al. ..... 112/220
3,266,449 A * 8/1966 Berg et al. ..... 112/221
3,839,972 A * 10/1974 Scott et al. ..... 112/80.42
3,875,489 A * 4/1975 Von Brimer ..... 318/691
4,013,028 A * 3/1977 Murakami ..... 112/220
4,108,096 A * 8/1978 Ciecior ..... 112/221
4,388,885 A * 6/1983 Dreier ..... 112/221
4,430,953 A * 2/1984 Spies ..... 112/165
4,458,611 A * 7/1984 Arendash ..... 112/443
4,513,674 A * 4/1985 Bhatia et al. ..... 112/220
4,515,096 A * 5/1985 Ingram ..... 112/80.42
4,539,922 A * 9/1985 Klundt ..... 112/221
4,554,840 A * 11/1985 Marchesi ..... 74/42
4,616,585 A * 10/1986 Marcandalli ..... 112/221
5,086,719 A * 2/1992 Ogawa ..... 112/225
(Continued)

FOREIGN PATENT DOCUMENTS

EP 254958 A1 * 2/1988 ..... D05B 27/14

OTHER PUBLICATIONS http://web.archive.org/web/20130415063037/http://www.sailrite.com/Needle-Bar-Connecting-Rod-for-Ultrafeeds.*

*Primary Examiner* — Megan Lynch
(74) *Attorney, Agent, or Firm* — Maschoff Brennan

(57) ABSTRACT

Vibration reduction mechanism for a sewing machine. In one example embodiment, a vibration reduction mechanism for a sewing machine includes a rotational counterweight and a reciprocating counterweight. The rotational counterweight is configured to be coupled to a driveshaft of a sewing machine and is configured to be rotated by rotation of the driveshaft. The reciprocating counterweight is coupled to the rotational counterweight. A first portion of the reciprocating counterweight is configured to be rotated by the rotation of the rotational counterweight. A second portion of the reciprocating counterweight is configured to be substantially reciprocated along a length of a structure by the rotation of the rotational counterweight.

19 Claims, 10 Drawing Sheets

(56) References Cited

U.S. PATENT DOCUMENTS

| | | | | |
|---|---|---|---|---|
| 5,092,257 | A * | 3/1992 | Ogawa | 112/225 |
| 5,097,775 | A * | 3/1992 | Ogawa et al. | 112/225 |
| 5,320,053 | A * | 6/1994 | Beasley | 112/80.42 |
| 5,549,062 | A * | 8/1996 | Yamashita et al. | 112/220 |
| 5,651,287 | A * | 7/1997 | Tseng | 74/42 |
| 5,870,960 | A * | 2/1999 | Brown | 112/220 |
| 6,748,888 | B1 * | 6/2004 | Chen | 112/220 |
| 7,597,058 | B2 * | 10/2009 | Ishikawa et al. | 112/220 |
| 7,654,209 | B2 * | 2/2010 | Park | 112/220 |
| 7,845,295 | B2 * | 12/2010 | Park | 112/220 |
| 8,096,251 | B2 * | 1/2012 | Suzuki | 112/475.01 |
| 2003/0172860 | A1 * | 9/2003 | Kong | 112/220 |
| 2005/0178307 | A1 * | 8/2005 | Frazer et al. | 112/117 |
| 2007/0261621 | A1 * | 11/2007 | Suzuki et al. | 112/220 |
| 2009/0199752 | A1 * | 8/2009 | James et al. | 112/117 |
| 2009/0249990 | A1 * | 10/2009 | Park | 112/284 |
| 2010/0126396 | A1 * | 5/2010 | Stutznacker | 112/165 |
| 2012/0097083 | A1 * | 4/2012 | James et al. | 112/117 |
| 2012/0318181 | A1 * | 12/2012 | Kasa | 112/117 |

* cited by examiner

VIBRATION REDUCTION MECHANISM FOR A SEWING MACHINE

FIELD

The embodiments disclosed herein relate to a vibration reduction mechanism for a sewing machine.

BACKGROUND

Sewing machines typically function to form a row of stitches in one or more layers of fabric using a combination of thread from a spool, also known as top thread, and thread from a bobbin, also known as bottom thread. The top thread is generally stitched into the fabric by a needle attached to a needle bar that reciprocates the needle into and out of the fabric.

One common problem encountered by a user of a typical sewing machine is the vibration created by the reciprocating needle bar, as well as by the motion of other components of the sewing machine. This vibration can be distracting to the user, and in extreme cases, hamper the user from accurately placing a row of stitches in one or more layers of fabric during operation of the sewing machine. This vibration may be particularly pronounced in a sewing machine that is specialized for quilting, known as a long-arm quilting machine, because the resultant forces may be amplified in the longer arm of a long-arm quilting machine. These amplified vibrations may be particularly distracting to a user because the user typically holds onto handle bars attached at the front end of the long-arm quilting machine in order to move the long-arm quilting machine relative to the fabric.

The subject matter claimed herein is not limited to embodiments that solve any disadvantages or that operate only in environments such as those described above. Rather, this background is only provided to illustrate one example technology area where some embodiments described herein may be practiced.

SUMMARY

In general, example embodiments described herein relate to a vibration reduction mechanism for a sewing machine. One example vibration reduction mechanism disclosed herein may include a reciprocating counterweight having a portion that is configured to substantially reciprocate along a length of a structure. Another example vibration reduction mechanism disclosed herein may include first and second rotational counterweights coupled to first and second driveshafts, respectively, where the first and second driveshafts are configured to rotate in opposite rotational directions and the coordinated movement of the first and second rotational counterweights is substantially together along a first axis and is substantially opposite along a second perpendicular axis. When employed in a sewing machine, the example vibration reduction mechanisms disclosed herein may reduce the vibration in the sewing machine that is caused by the reciprocating motion of the needle bar of the sewing machine, as well as by the motion of other components of the sewing machine. This reduction in the vibration of the sewing machine may reduce the distraction of the vibration to the user and may aid the user in accurately placing a row of stitches in one or more layers of fabric during operation of the sewing machine.

In one example embodiment, a vibration reduction mechanism for a sewing machine includes a rotational counterweight and a reciprocating counterweight. The rotational counterweight is configured to be coupled to a driveshaft of a sewing machine and is configured to be rotated by rotation of the driveshaft. The reciprocating counterweight is coupled to the rotational counterweight. A first portion of the reciprocating counterweight is configured to be rotated by the rotation of the rotational counterweight. A second portion of the reciprocating counterweight is configured to be substantially reciprocated along a length of a structure by the rotation of the rotational counterweight.

In another example embodiment, a vibration reduction mechanism for a sewing machine includes a first driveshaft configured to rotate in a first rotational direction, a first rotational counterweight coupled to the first driveshaft with the first driveshaft positioned between a first higher mass portion of the first rotational counterweight and a first lower mass portion of the first rotational counterweight, a second driveshaft configured to rotate in a second rotational direction that is opposite from the first rotational direction, and a second rotational counterweight coupled to the second driveshaft with the second driveshaft positioned between a second higher mass portion of the second rotational counterweight and a second lower mass portion of the second rotational counterweight. In this example, the first rotational counterweight and the second rotational counterweight are coordinated such that the first and second higher mass portions are configured to move substantially together along a first axis and are configured to move substantially opposite one another along a second axis that is perpendicular to the first axis.

In another example embodiment, a sewing machine includes a support frame, a driveshaft, a needle bar configured to have a needle attached thereto, a vibration reduction mechanism, and an electric motor. The vibration reduction mechanism includes a structure integrally formed in, or attached to, the support frame, a rotational counterweight coupled to the driveshaft, and a reciprocating counterweight coupled to the rotational counterweight. The reciprocating counterweight includes a first portion and a second portion. The electric motor is configured to rotate the driveshaft. The rotation of the driveshaft causes the needle bar to reciprocate the needle into and out of a fabric, the rotational counterweight to rotate, the first portion of the reciprocating counterweight to rotate, and the second portion of the reciprocating counterweight to substantially reciprocate along a length of the structure.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1A:
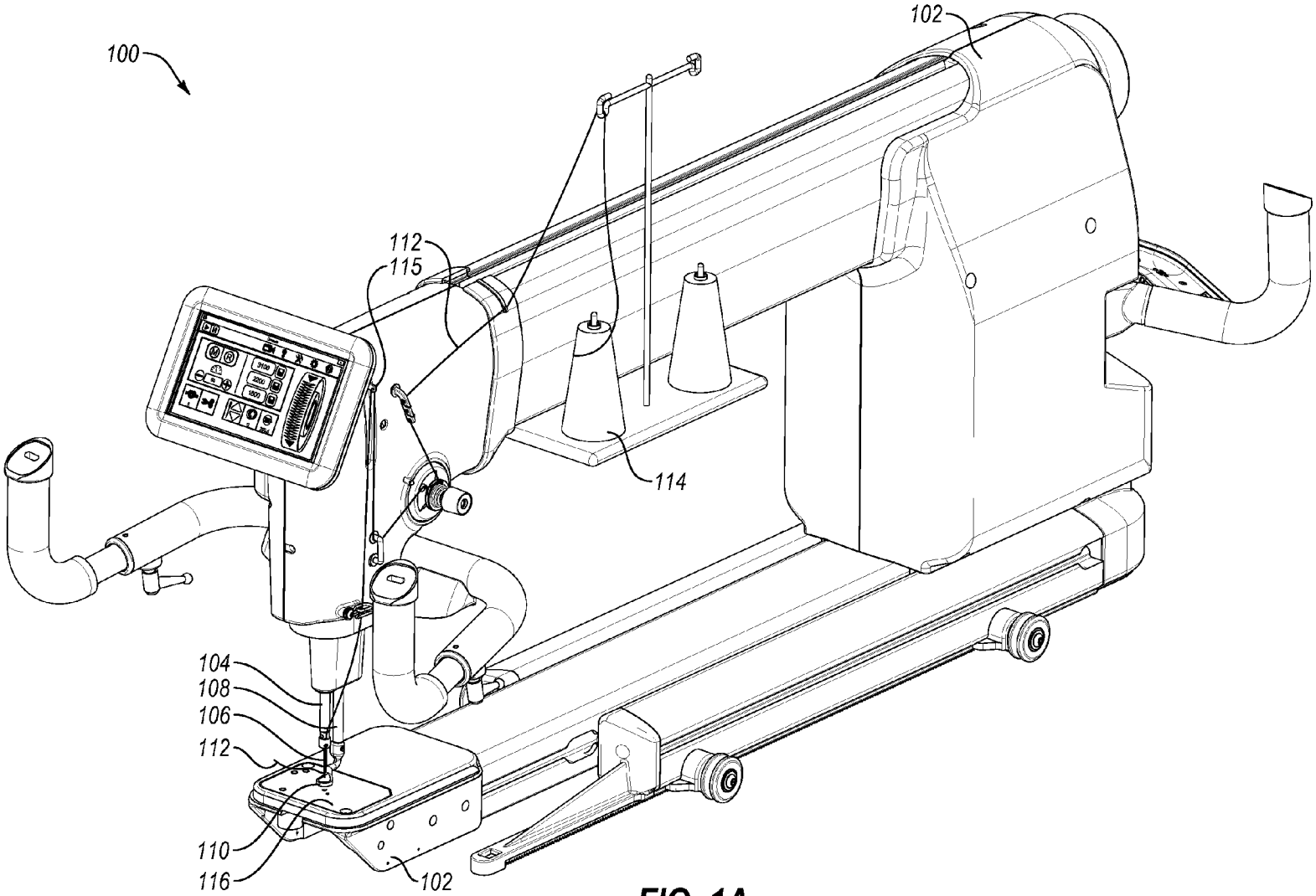
FIG. 1A is a front perspective view of an example sewing machine including an example needle bar and an example presser bar.
Figure 1B:
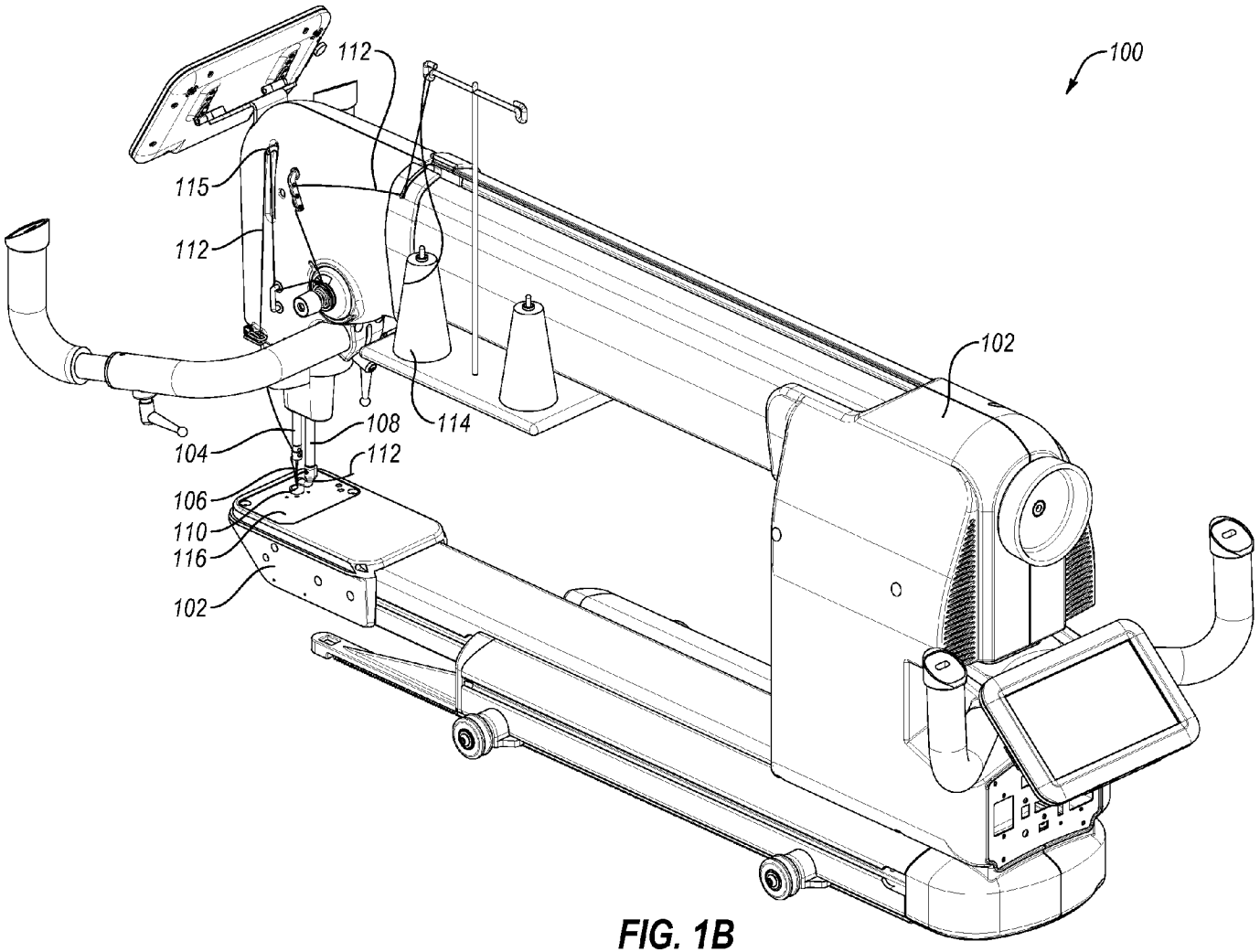
FIG. 1B is a rear perspective view of the example sewing machine of FIG. 1A.

FIG. 1A is a front perspective view of an example sewing machine 100, and FIG. 1B is a rear perspective view of the example sewing machine 100. The example sewing machine 100 of FIGS. 1A and 1B is specialized for quilting and is known as a long-arm quilting machine. Quilting typically involves stitching together multiple layers of fabric to form a quilt. A quilt typically includes a layer of batting sandwiched in between upper and lower layers of fabric.

Figure 2:
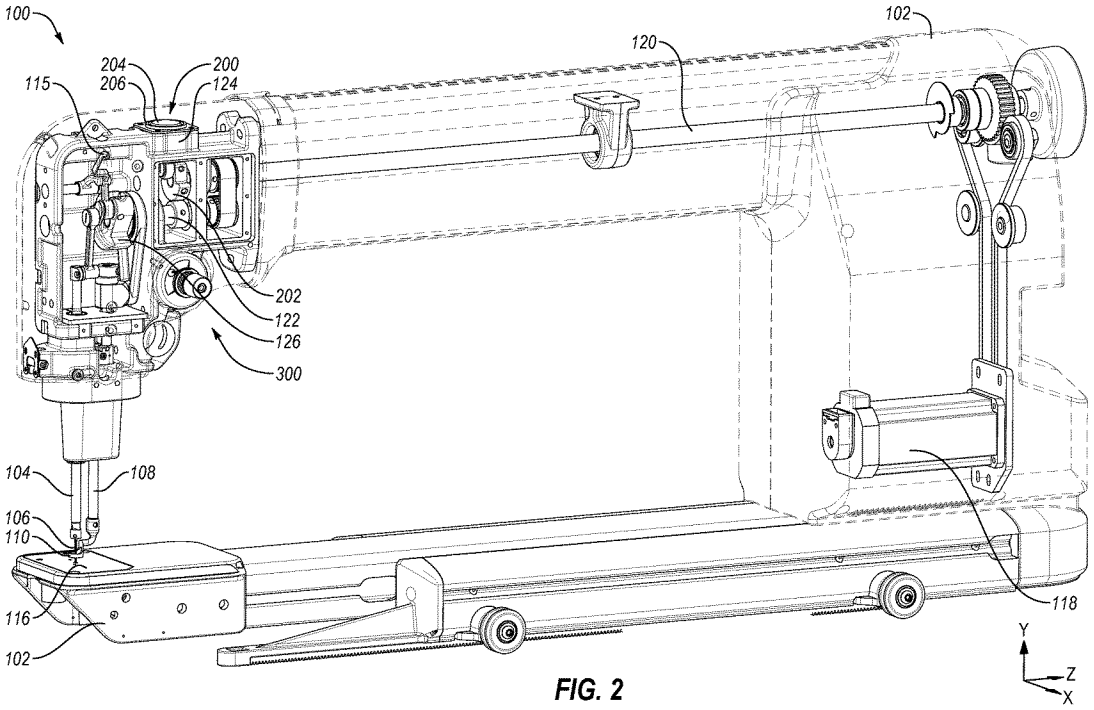
FIG. 2 is a partial perspective view of the example sewing machine of FIG. 1A including a first example vibration reduction mechanism and a second example vibration reduction mechanism.

As disclosed in FIGS. 1A and 1B, the sewing machine 100 may include one or more housings 102 which house various internal components of the sewing machine 100, some of which are disclosed in greater detail in FIG. 2. The sewing machine 100 may also include a needle bar 104 that is configured to have a needle 106 attached thereto and a presser bar 108 having a hopping foot 110 attached thereto. A top thread 112 from a spool 114 may be passed through various thread guides, including a take-up lever 115, until finally the top thread 112 is threaded through the eye of the needle 106.

Although not shown in FIGS. 1A and 1B, it is understood that the sewing machine may also include a bobbin case configured to hold a bobbin that is wound with bottom thread, and a bobbin hook, both generally positioned in the housing 102 underneath a needle plate 116.

During operation of the sewing machine 100, the threaded needle 106 may be repeatedly driven through one or more layers of fabric (not shown). Simultaneously, the bobbin hook may be driven to repeatedly catch the top thread 112 (which has been driven through the one or more layers of fabric) and loop the top thread 112 around the bobbin, and then the take-up lever 115 may be driven to take up the top thread 112, to form a row of stitches, also known as lock stitches, of the top thread 112 and the bottom thread in the one or more layers of fabric. Also simultaneously, the hopping foot 110 may be repeatedly driven up and down to alternate between holding the one or more layers of fabric in place during the finalization of each stitch and releasing the one or more layers of fabric to facilitate their movement between each stitch.

The repeated up-and-down motion (as oriented in FIGS. 1A and 1B), also known as reciprocating motion, of the needle bar 104 and the presser bar 108 during operation of the sewing machine 100, as well as the motion of the take-up lever 115 and the motion of other components including mechanical linkages of the sewing machine 100, may cause the sewing machine 100 to vibrate. This vibration can be distracting to the user. Also, in extreme cases, this vibration may hamper the user in accurately placing a row of stitches in one or more layers of fabric during operation of the sewing machine 100.

In order to reduce this vibration, the sewing machine 100 may include a first vibration reduction mechanism 200 and/or a second vibration reduction mechanism 300, as disclosed in greater detail in connection with FIGS. 2-4C, that may reduce vibration in the sewing machine 100 caused by the reciprocating motion of the needle bar 104 and the presser bar 108, as well as by the motion of other components of the sewing machine 100. This reduction in the vibration of the sewing machine 100 may reduce the distraction of the vibration to the user and may aid the user in accurately placing a row of stitches in one or more layers of fabric during operation of the sewing machine 100.

Although the example sewing machine 100 of FIGS. 1A and 1B is a long-arm quilting machine, it is understood that the sewing machine 100 of FIGS. 1A and 1B is only one of countless sewing machines in which the example vibration reduction mechanisms 200 and 300 may be employed. The scope of the example vibration reduction mechanisms 200 and 300 are therefore not intended to be limited to employment in any particular sewing machine.

FIG. 2 is a partial perspective view of the example sewing machine 100 including the first example vibration reduction mechanism 200 and the second example vibration reduction mechanism 300. As disclosed in FIG. 2, the one or more housings 102 of the sewing machine 100 may house various internal components including an electric motor 118, a first driveshaft 120, the vibration reduction mechanism 200, a second driveshaft 122, a support frame 124, and the take-up lever 115. During operation of the sewing machine 100, the electric motor 118 may be configured, among other things, to rotate the first driveshaft 120.

The rotation of the first driveshaft 120 may cause motion in various other components of the sewing machine 100, including motion in the vibration reduction mechanism 200, the needle bar 104, and the presser bar 108, which motion is discussed in greater detail in connection with FIGS. 3A-3E. In general, however, the rotation of the first driveshaft 120 may directly cause rotation of a rotational counterweight 202, and indirectly cause a substantial reciprocation of a reciprocating counterweight 204 of the vibration reduction mechanism 200. Simultaneously, the rotation of the first driveshaft 120 may indirectly cause, via rotation of the second driveshaft 122 due to a transmission and motion in the take-up lever 115 and various other mechanical linkages, the reciprocating motions of the needle bar 104 and the presser bar 108, which result in the needle 106 reciprocating into and out of a fabric (not shown) and the hopping foot 110 reciprocating onto and off of the fabric. It is understood that in some example embodiments the functionality of the first driveshaft 120 and the second driveshaft 122 may be accomplished using a single driveshaft.

The reciprocating motion of the reciprocating counterweight 204 of the vibration reduction mechanism 200 may reduce vibration in the sewing machine 100 caused by the reciprocating motion of the needle bar 104 and the presser bar 108, as well as by the motion of other components of the sewing machine 100 such as the take-up lever 115.

Additionally or alternatively, the sewing machine 100 may include the second vibration reduction mechanism 300, as disclosed in FIG. 2, that may reduce vibration in the sewing machine 100 caused by the reciprocating motion of the needle bar 104 and the presser bar 108, as well as by the motion of other components of the sewing machine 100. The second vibration reduction mechanism 300 may include the first driveshaft 120, the second driveshaft 122 (which may be substantially parallel to the first driveshaft 120 and both of which may be substantially perpendicular to the reciprocating motion of the needle bar 104 and the presser bar 108), a first rotational counterweight, such as the rotational counterweight 202, coupled to the first driveshaft 120 with the first driveshaft 120 positioned between a higher mass portion of the first rotational counterweight and a lower mass portion of the first rotational counterweight, and a second rotational counterweight, such as a rotational counterweight 126, coupled to the second driveshaft 122 with the second driveshaft 122 positioned between a higher mass portion of the second rotational counterweight and a lower mass portion of the second rotational counterweight.

Unlike the configuration disclosed in FIG. 2 where the first driveshaft 120 and the second driveshaft 122 are configured to rotate in the same rotational directions, the second vibration reduction mechanism 300 may be configured such that the first driveshaft 120 rotates in a first rotational direction while the second driveshaft 122 rotates in a second rotational direction that is opposite from the first rotational direction. The second vibration reduction mechanism 300 may also be configured such that the first rotational counterweight and the second rotational counterweight are coordinated such that the first and second higher mass portions are configured to move substantially together along a y axis (i.e., while moving up and down) and are configured to move substantially opposite one another along an x axis (i.e., while moving side to side) that is perpendicular to the y axis.

This coordination of the first and second rotational counterweights may involve the higher mass portions moving in a substantially downward motion while the needle bar 104 and the presser bar 108 are moving in a substantially opposite upward direction. Similarly, this coordination of the first and second rotational counterweights may involve the higher mass portions moving in a substantially upward motion while the needle bar 104 and the presser bar 108 are moving in a substantially opposite downward motion. The coordinated motion of the higher mass portions being substantially opposite to the reciprocating motion of the needle bar 104 and the presser bar 108 may reduce vibration in the sewing machine 100 caused by the reciprocating motion of the needle bar 104 and the presser bar 108, and by the motion of other components of the sewing machine 100.

As disclosed in FIG. 2, the reciprocating counterweight 204 of the first example vibration reduction mechanism 200 and/or the first and second rotational counterweights 202 and 126 of the second example vibration reduction mechanism 300 may be positioned in x-y planes that are relatively close to the x-y planes in which the needle bar 104 and the presser bar 108, as well as other moving components of the sewing machine 100, are positioned. This relatively close placement of the counterweights of the first vibration reduction mechanism 200 and/or the second vibration reduction mechanism 300 to the sources of the vibration in the sewing machine 100 may increase the effectiveness of the first vibration reduction mechanism 200 and/or the second vibration reduction mechanism 300. It is understood that the first vibration reduction mechanism 200 and/or the second vibration reduction mechanism 300 may be driven at a 1:1 ratio, or driven at something other than a 1:1 ratio, relative to the reciprocating frequency of the needle bar 104, the presser bar 108, and take-up lever 115.

The reduction in the vibration of the sewing machine 100 caused by the first vibration reduction mechanism 200 and/or the second vibration reduction mechanism 300 may reduce the distraction of the vibration to the user and may aid the user in accurately placing a row of stitches in one or more layers of fabric during operation of the sewing machine 100.

FIGS. 3A-3E are partial cross-sectional side views of positions of the example needle bar 104 and the example presser bar 108 corresponding to partial cross-sectional front views of 12, 3, 6, 9, and 12 o'clock positions of the example vibration reduction mechanism, respectively. The complementary operation of the example vibration reduction mechanism 200, the example needle bar 104, and the example presser bar 108 will now be discussed in connection with FIGS. 3A-3E.

As disclosed in FIGS. 3A-3E, the vibration reduction mechanism 200 may include the rotational counterweight 202, the reciprocating counterweight 204, and a hollow cylinder 206. The rotational counterweight 202 may be coupled to the first driveshaft 120 and may be configured to be rotated 208 by a rotation of the driveshaft. The reciprocating counterweight 204 may be coupled to the rotational counterweight 202. A first portion 209 (see FIG. 3A) of the reciprocating counterweight 204 may be configured to be rotated 208 by the rotation of the rotational counterweight 202. A second portion 211 (see FIG. 3A) of the reciprocating counterweight may be configured to be substantially reciprocated 210 along a length LC of the hollow cylinder 206 by the rotation 208 of the rotational counterweight 202.

Figure 3A:
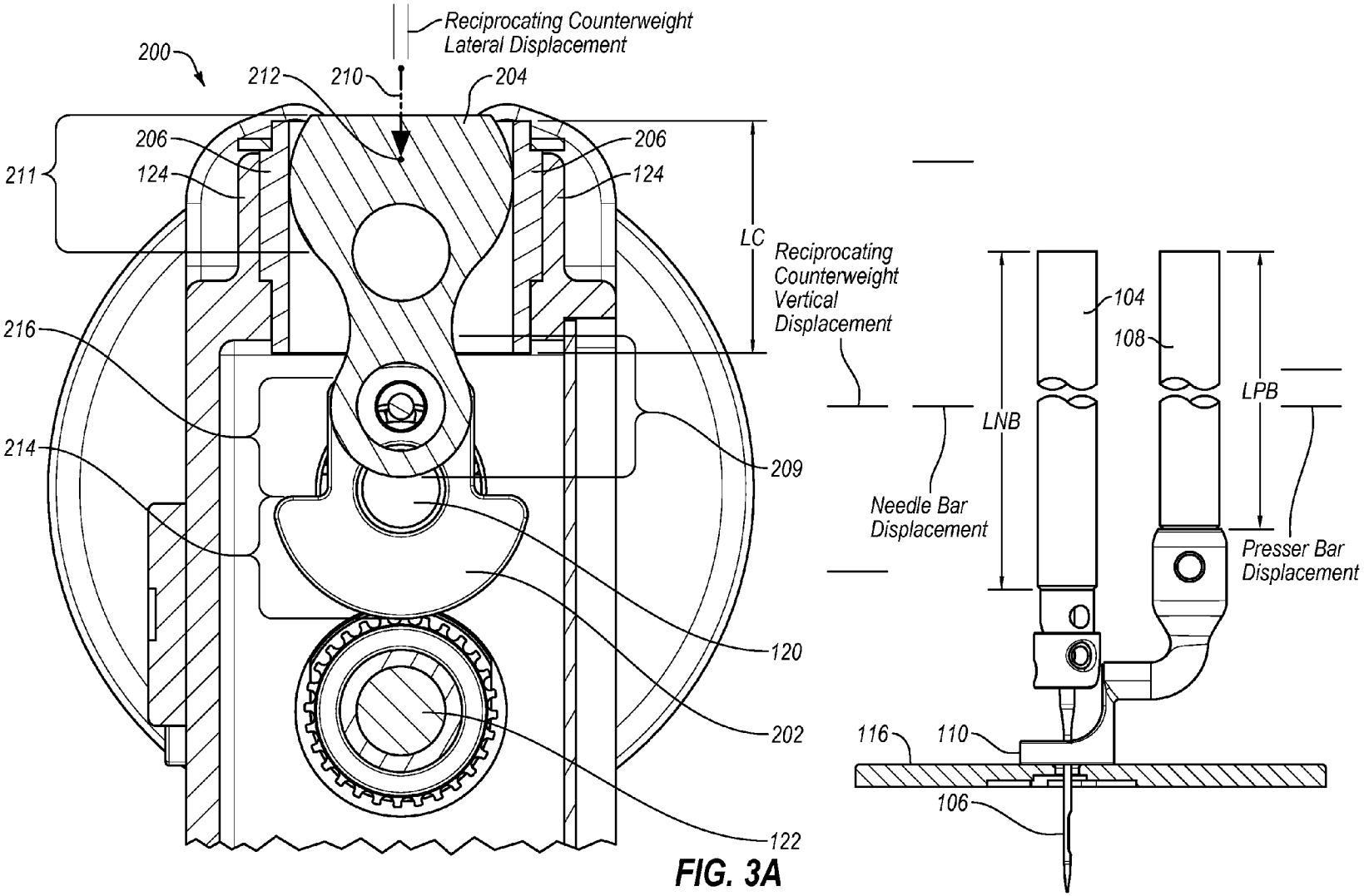
FIGS. 3A-3E are partial cross-sectional side views of positions of the example needle bar and the example presser bar of FIGS. 1A-2 corresponding to partial cross-sectional front views of 12, 3, 6, 9, and 12 o'clock positions of the first example vibration reduction mechanism of FIG. 2, respectively.

As disclosed in FIG. 3A, the rotational counterweight 202 may be coupled to the first driveshaft 120 with the first driveshaft 120 positioned between a higher mass portion 214 of the rotational counterweight 202 and a lower mass portion 216 of the rotational counterweight 202. The reciprocating counterweight 204 may be coupled to the lower mass portion 216 of the rotational counterweight 202. Coupling of the reciprocating counterweight 204 to the lower mass portion 216 of the rotational counterweight 202 may allow the higher mass portion 214 of the rotational counterweight 202 to balance the rotational counterweight 202 during rotation of the rotational counterweight 202, which may enable the first portion 211 of the reciprocating counterweight 204 to function as a connecting rod and to impart some lateral counterbalancing during rotation of the rotational counterweight 202.

As disclosed in FIGS. 3A-3E, while the rotational counterweight 202 and the reciprocating counterweight 204 are in motion during operation of the sewing machine 100, the hollow cylinder 206 may be configured to remain stationary. Further, the hollow cylinder 206 may be integrally formed in the support frame 124 of the sewing machine 100 or may be attached to the support frame 124 of the sewing machine 100. As disclosed in FIG. 3A, the length LC of the hollow cylinder 206 may be oriented substantially parallel to the length LNB of the needle bar 104 and the length LPB of the presser bar 108.

Figure 3B:
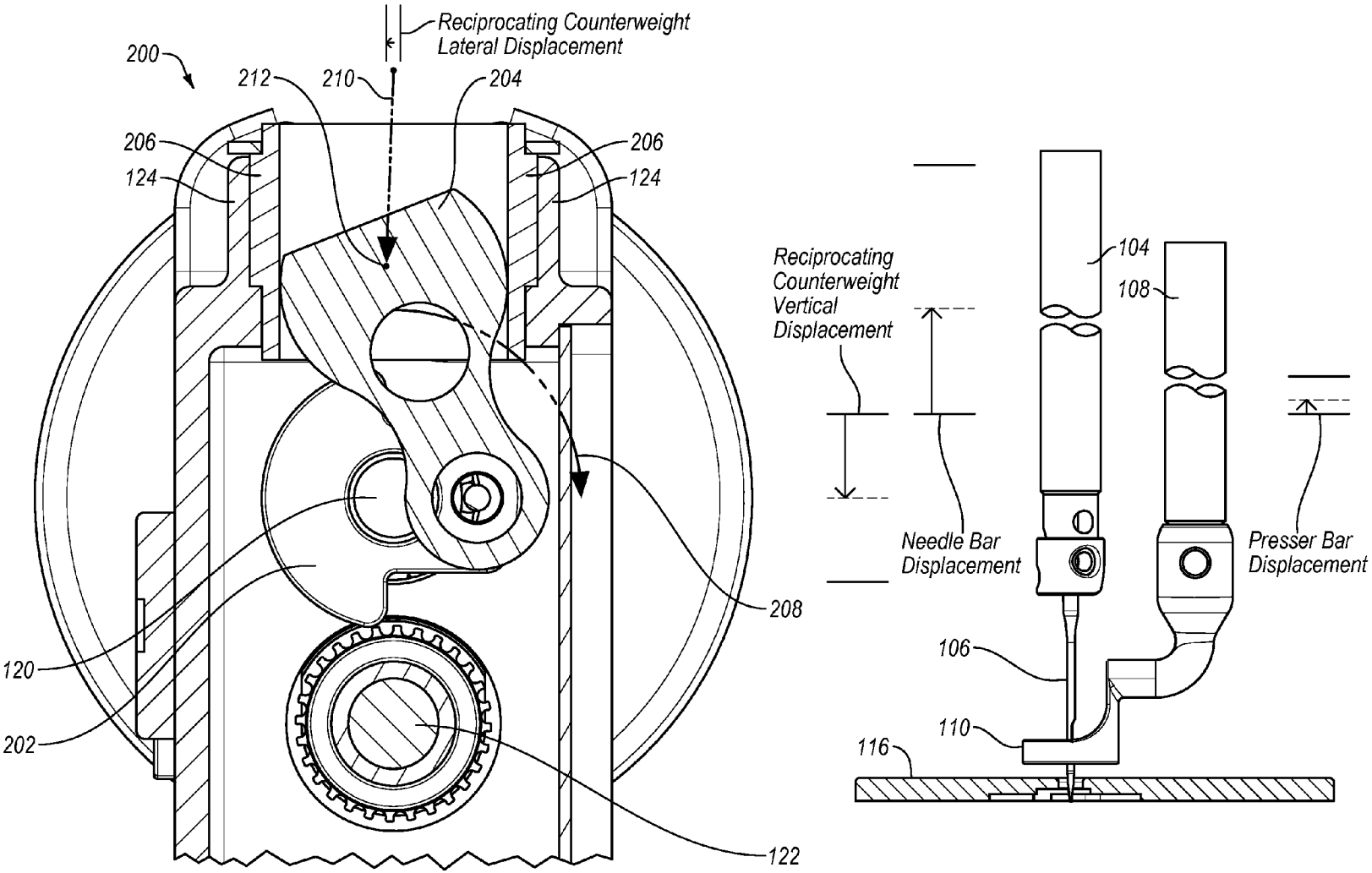
Figure 3C:
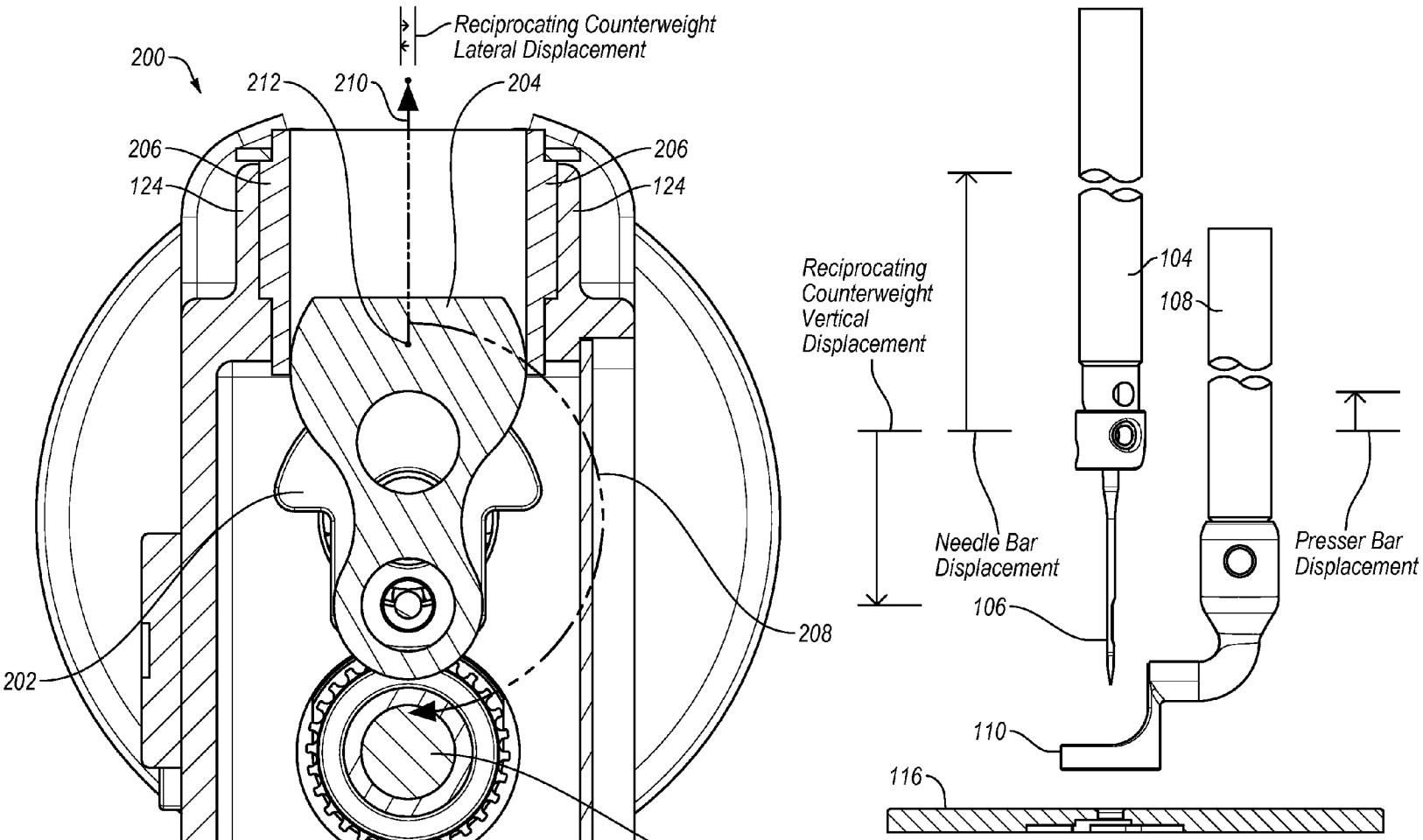

As disclosed in FIGS. 3A-3E, during the substantially reciprocating motion 210 of the reciprocating counterweight 204 and the simultaneous reciprocating motion of the needle bar 104 and the presser bar 108, while the reciprocating counterweight 204 is moving in a substantially downward direction, as disclosed in FIGS. 3A-3C, the needle bar 104 and the presser bar 108 are moving in a substantially opposite upward direction. Similarly, while the reciprocating counterweight 204 is moving in a substantially upward direction, as disclosed in FIGS. 3C-3E, the needle bar 104 and the presser bar 108 are moving in a substantially opposite downward motion. The substantially reciprocating motion 210 of the reciprocating counterweight 204 being substantially opposite to the reciprocating motion of the needle bar 104 and the presser bar 108 may reduce vibration in the sewing machine 100 caused by the reciprocating motion of the needle bar 104 and the presser bar 108.

Figure 3D:
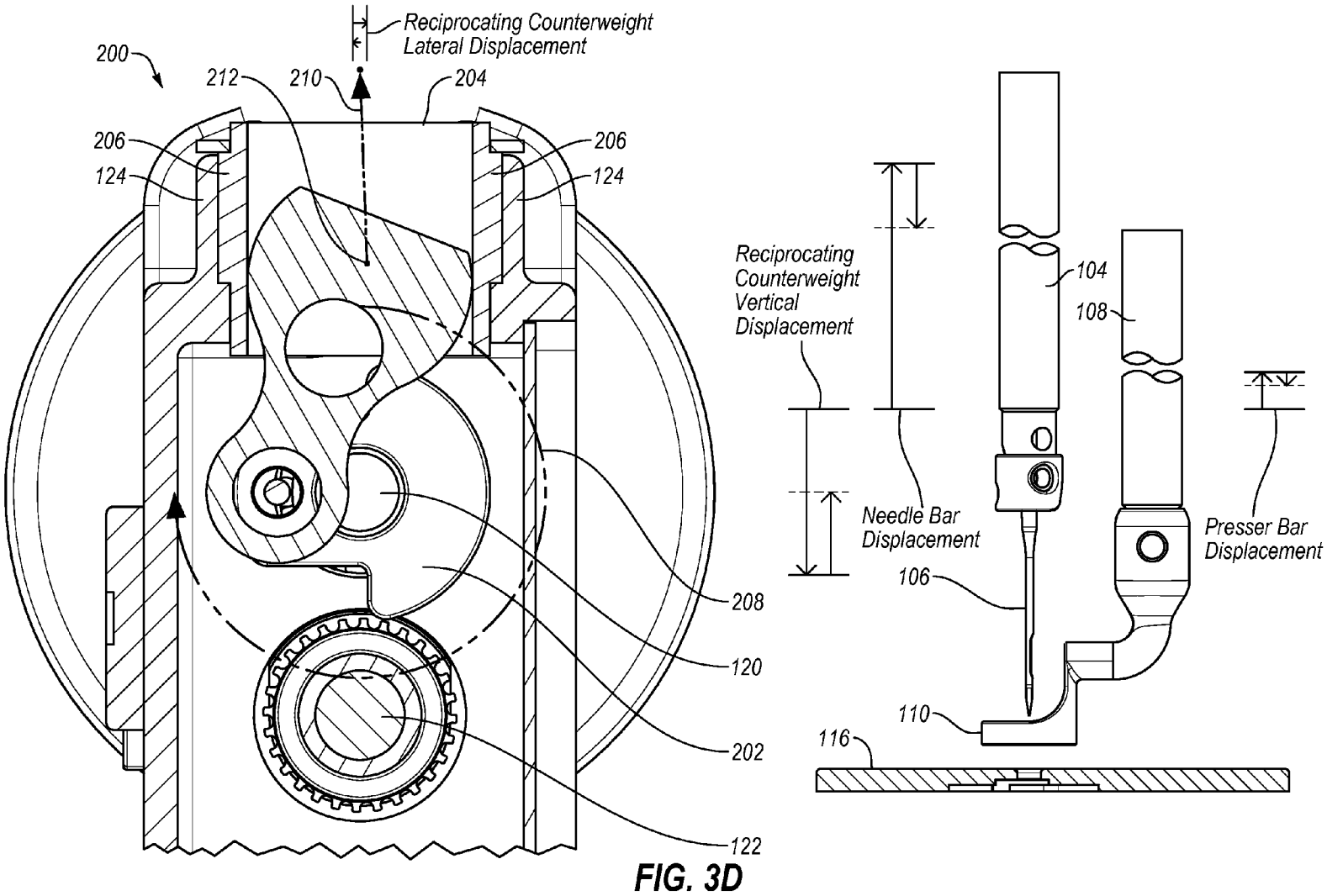
Figure 3E:
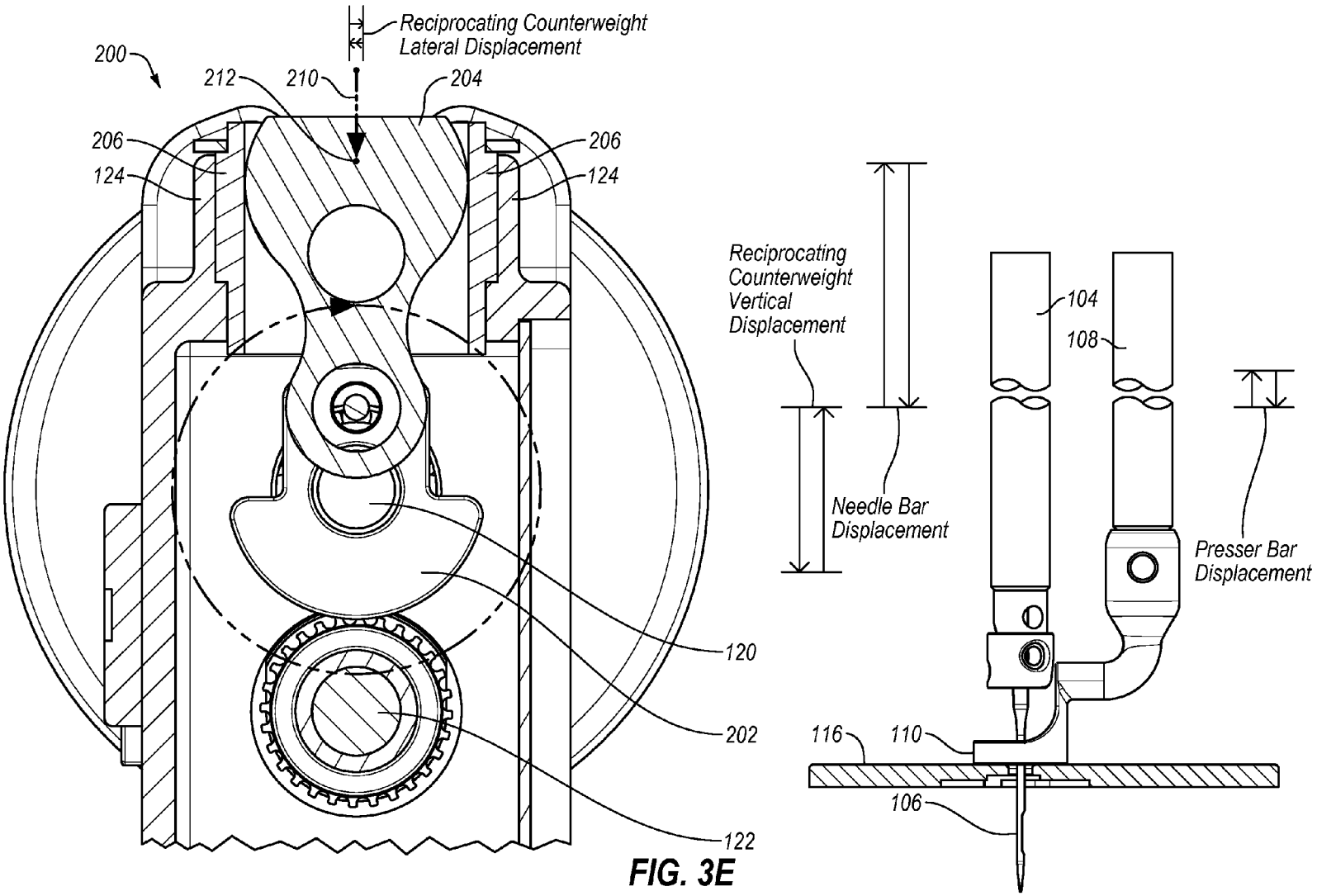

As disclosed in FIGS. 3A-3E, during the substantially reciprocating motion 210 of the reciprocating counterweight 204, while the reciprocating counterweight 204 is moving clockwise between the 3 and 9 o'clock positions, as disclosed in FIGS. 3B-3D, the center of mass 212 of the reciprocating counterweight 204 may pivot slightly to the right, and while the reciprocating counterweight 204 is moving clockwise between the 9 and 3 o'clock positions, as disclosed in the progression through FIGS. 3D, 3E, and 3B, the center of mass 212 of the reciprocating counterweight 204 may pivot slightly to the left. This side-to-side pivoting of the center of mass 212 of the reciprocating counterweight 204 may be substantially opposite to the side-to-side motions of other components of the sewing machine 100, such as the side-to-side motion of mechanical linkages of the take-up lever 115 and the side-to-side motions of other mechanical linkages. The side-to-side pivoting of the center of mass 212 of the reciprocating counterweight 204 being substantially opposite to the side-to-side motions of components of the sewing machine 100 may reduce vibration in the sewing machine 100 caused by the side-to-side motions of these components of the sewing machine 100.

This reduction in the vibration of the sewing machine 100 may reduce the distraction of the vibration to the user and may aid the user in accurately placing a row of stitches in one or more layers of fabric during operation of the sewing machine 100.

Figure 4A:
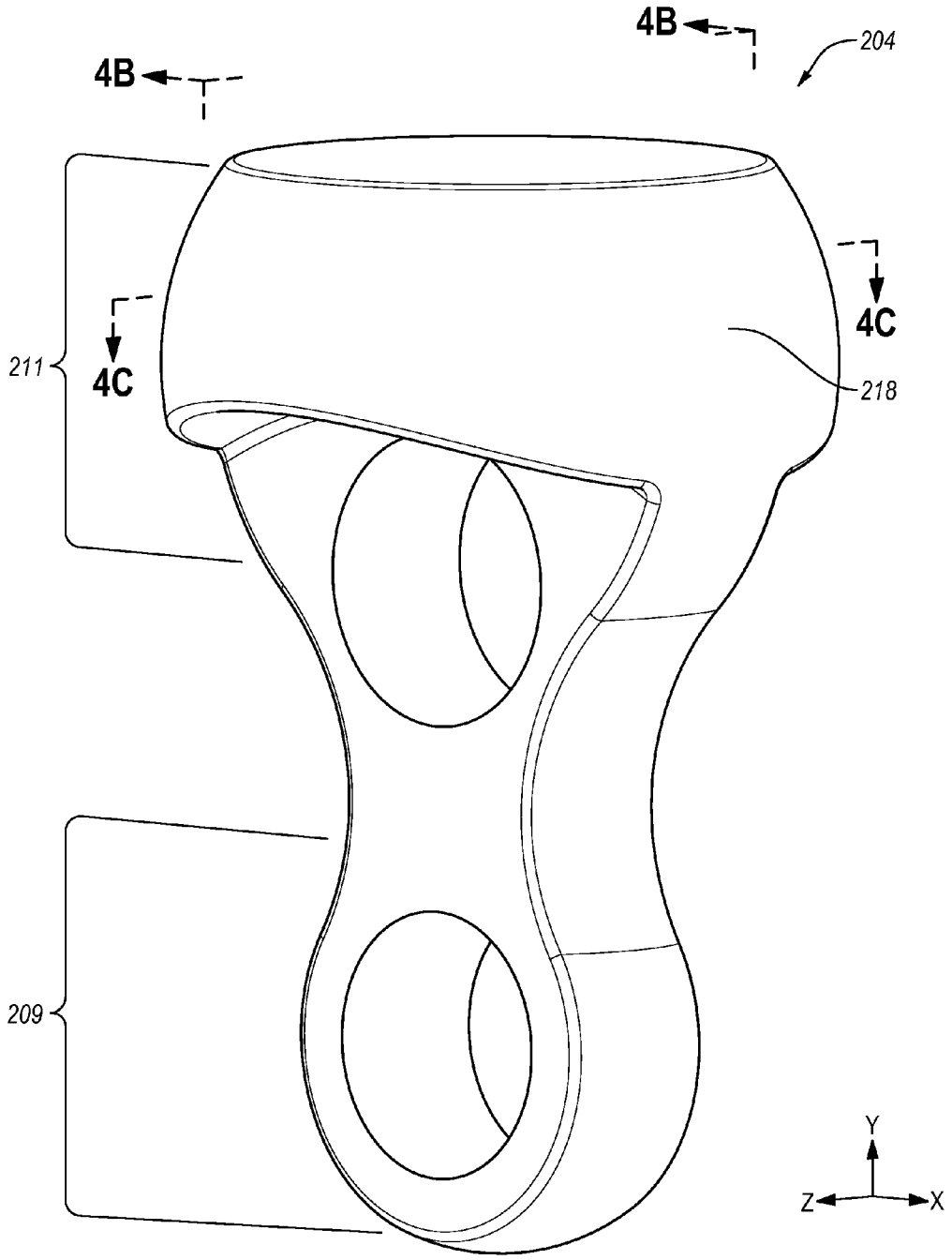
FIG. 4A is a perspective view of an example reciprocating counterweight of the first example vibration reduction mechanism of FIG. 2.

FIG. 4A is a perspective view of the example reciprocating counterweight 204 of the example vibration reduction mechanism 200. As disclosed in FIG. 4A, a surface 218 of the second portion 211 of the reciprocating counterweight 204 that is configured to make contact with the hollow cylinder 206 (see FIGS. 3A-3E) is curved in two dimensions. As disclosed in FIGS. 3A-3E, the curvature of the surface 218 may allow the second portion 211 of the reciprocating counterweight 204 to pivot from side to side within the hollow cylinder 206 during the substantially reciprocating motion of the second portion 211 of the reciprocating counterweight 204 within the hollow cylinder 206.

Figure 4C:
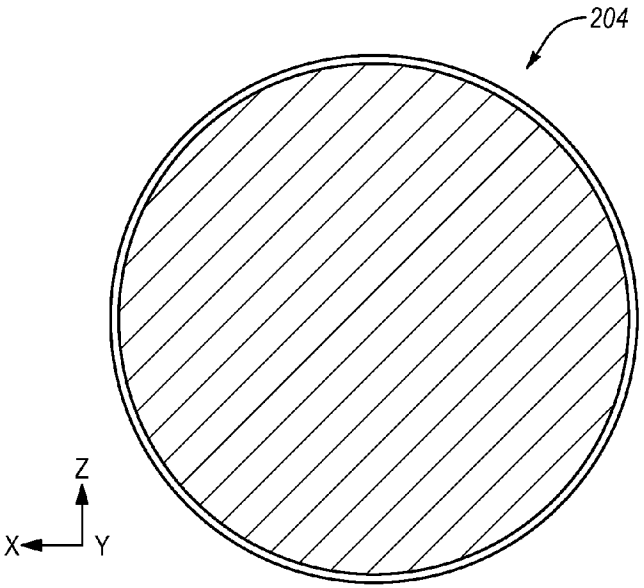
FIG. 4C is a cross-sectional top view of the example reciprocating counterweight of FIG. 4A.
Figure 4B:
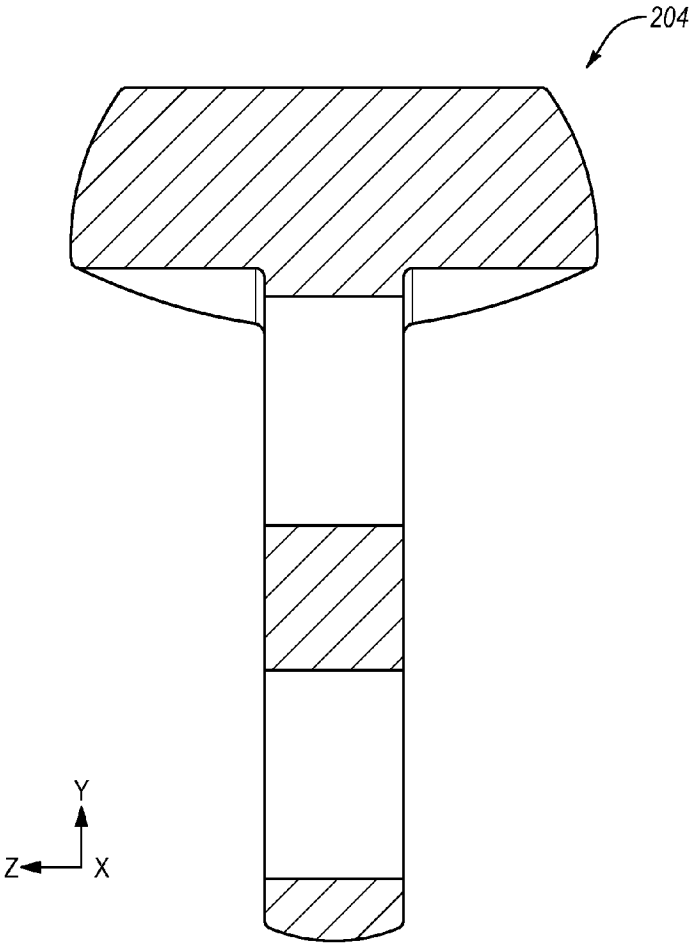
FIG. 4B is a cross-sectional side view of the example reciprocating counterweight of FIG. 4A.

FIG. 4B is a cross-sectional side view of the example reciprocating counterweight 204 of the example vibration reduction mechanism 200. As disclosed in FIG. 4B, a cross section of the reciprocating counterweight 204 in the Y-Z plane may be substantially T-shaped. As disclosed in FIGS. 3A and 4A, the substantially T-shaped cross-sectional shape of the reciprocating counterweight 204 may allow the second portion 211 of the reciprocating counterweight 204 to have a higher mass than the first portion 209 of the reciprocating counterweight. The second portion 211 of the reciprocating counterweight 204 having a higher mass than the first portion 209 of the reciprocating counterweight 204 may increase the effect of the substantially reciprocating motion of the second portion 211. Further, the first portion 209 of the reciprocating counterweight 204 may provide a lateral counterbalancing effect to mitigate the lateral, or side to side, vibrations cause by the mechanical linkages, such as connecting rods, etc., of the needle bar 104 and the presser bar 108. This effect may be similar to the effect of a conventional piston and connecting rod joined by an articulating wrist pin.

FIG. 4C is a cross-sectional top view of the example reciprocating counterweight 204 of the example vibration reduction mechanism 200. As disclosed in FIG. 4C, a cross section of the second portion 211 of the reciprocating counterweight 204 may be substantially circular. As disclosed in FIGS. 2, 3A, and 4A, the substantially circular cross-sectional shape of the second portion 211 of the reciprocating counterweight 204 may allow the second portion 211 of the reciprocating counterweight 204 to be substantially reciprocated along the length LC of the hollow cylinder 206, which also has a substantially circular cross-sectional shape.

It is understood that in many sewing machines the presser bar and foot attached thereto are stationary during operation instead of being reciprocating. In such sewing machines, the example vibration reduction mechanisms 200 and/or 300 disclosed herein may be configured to reduce vibration caused only by the reciprocating motion of the needle bar and the motion of the take-up lever and the motion of other components including mechanical linkages of the sewing machine. It is also understood that the hollow cylinder 206 is only one example structure that can be configured to guide the reciprocating motion of the reciprocating counterweight 204. Other example structures include one or more guide rails that either surround or run through the reciprocating counterweight 204. Where the one or more guide rails run through the reciprocating counterweight 204, the reciprocating counterweight 204 may be modified to replace the second part 209 of the reciprocating counterweight 204 with a connecting rod that is pivotally connected both to the rotational counterweight 202 and to the second part 211 of the reciprocating counterweight 204. This connecting rod may allow the second part 211 of the reciprocating counterweight 204 to slide in a substantially linear fashion along the one or more guide rails that run through the reciprocating counterweight 204, and may also allow various changes to the shape and surfaces of the reciprocating counterweight 204.

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A vibration reduction mechanism for a sewing machine, the vibration reduction mechanism comprising:

a rotational counterweight configured to be coupled to a driveshaft of a sewing machine and configured to be rotated by rotation of the driveshaft;

a needle bar of the sewing machine configured to be coupled to the driveshaft and configured to be substantially linearly reciprocated by rotation of the driveshaft; and a reciprocating counterweight coupled to the rotational counterweight, a first portion of the reciprocating counterweight configured to be rotated by the rotation of the rotational counterweight, a second portion of the reciprocating counterweight configured to be substantially linearly reciprocated in a first substantially linear reciprocating motion that is substantially opposite to a second substantially linear reciprocating motion of the needle bar along a length of a structure by the rotation of the rotational counterweight.

2. The vibration reduction mechanism as recited in claim 1, wherein the structure is a hollow cylinder that is configured to remain stationary while the rotational counterweight and the reciprocating counterweight are in motion.

3. The vibration reduction mechanism as recited in claim 2, wherein the hollow cylinder is integrally formed in, or attached to, a support frame of the sewing machine.

4. The vibration reduction mechanism as recited in claim 3, wherein the length of the hollow cylinder is oriented substantially parallel to a length of the needle bar of the sewing machine.

5. The vibration reduction mechanism as recited in claim 4, wherein the first substantially linear reciprocating motion of the second portion of the reciprocating counterweight is configured to reduce vibration in the sewing machine caused by the second substantially linear reciprocating motion of the needle bar of the sewing machine into and out of a fabric.

6. The vibration reduction mechanism as recited in claim 5, wherein the sewing machine is a long-arm quilting machine.

7. The vibration reduction mechanism as recited in claim 1, wherein:

the rotational counterweight is configured to be coupled to the driveshaft with the driveshaft positioned between a higher mass portion of the rotational counterweight and a lower mass portion of the rotational counterweight; and the reciprocating counterweight is coupled to the lower mass portion of the rotational counterweight.

8. A vibration reduction mechanism for a sewing machine, the vibration reduction mechanism comprising:

a first driveshaft configured to rotate in a first rotational direction;

a first rotational counterweight coupled to the first driveshaft with the first driveshaft positioned between a first higher mass portion of the first rotational counterweight and a first lower mass portion of the first rotational counterweight;

a second driveshaft substantially parallel to the first driveshaft and configured to rotate in a second rotational direction that is opposite from the first rotational direction; and a second rotational counterweight coupled to the second driveshaft with the second driveshaft positioned between a second higher mass portion of the second rotational counterweight and a second lower mass portion of the second rotational counterweight, wherein the first rotational counterweight and the second rotational counterweight are coordinated such that the first and second higher mass portions are configured to move substantially together along a first axis and are configured to move substantially opposite one another along a second axis that is perpendicular to the first axis.

9. A sewing machine comprising:

the vibration reduction mechanism as recited in claim 8;

a needle bar configured to have a needle attached thereto; and an electric motor configured to rotate the first and second driveshafts and to substantially linearly reciprocate the needle of the needle bar into and out of a fabric;

wherein:

the first axis is oriented substantially parallel to a length of the needle bar of the sewing machine; and the movement substantially together of the first and second higher mass portions along the first axis is configured to reduce vibration in the sewing machine caused by a substantially linear reciprocating motion of the needle bar.

10. The sewing machine as recited in claim 9, wherein the sewing machine is a long-arm quilting machine.

11. A sewing machine comprising:

a support frame;

a driveshaft;

a needle bar configured to have a needle attached thereto;

a vibration reduction mechanism including:

a structure integrally formed in, or attached to, the support frame;

a rotational counterweight coupled to the driveshaft; and a reciprocating counterweight coupled to the rotational counterweight and including a first portion and a second portion; and an electric motor configured to rotate the driveshaft, which causes:

the needle bar to substantially linearly reciprocate the needle into and out of a fabric;

the rotational counterweight to rotate;

the first portion of the reciprocating counterweight to rotate; and the second portion of the reciprocating counterweight to substantially linearly reciprocate along a length of the structure in a first substantially linear reciprocating motion that is substantially opposite to a second substantially linear reciprocating motion of the needle bar.

12. The sewing machine as recited in claim 11, wherein the structure is a hollow cylinder and the length of the hollow cylinder is oriented substantially parallel to a length of the needle bar.

13. The sewing machine as recited in claim 11, wherein the first substantially linear reciprocating motion of the second portion of the reciprocating counterweight is configured to reduce vibration in the sewing machine caused by the second substantially linear reciprocating motion of the needle bar of the sewing machine.

14. The sewing machine as recited in claim 11, wherein a solid cross section of the second portion of the reciprocating counterweight is substantially circular.

15. The sewing machine as recited in claim 11, wherein a cross section of the reciprocating counterweight is substantially T-shaped.

16. The sewing machine as recited in claim 11, wherein the sewing machine is a long-arm quilting machine.

17. The sewing machine as recited in claim 16, wherein:

the sewing machine further comprises a presser bar having a hopping foot attached thereto; and the rotation of the driveshaft further causes the presser bar to substantially linearly reciprocate the hopping foot onto and off of the fabric in a third substantially linear reciprocating motion that is substantially opposite to the first substantially linear reciprocating motion of the second portion of the reciprocating counterweight.

18. The sewing machine as recited in claim 17, wherein the first substantially linear reciprocating motion of the second portion of the reciprocating counterweight is further configured to reduce vibration in the sewing machine caused by the third substantially linear reciprocating motion of the presser bar of the sewing machine.

19. The sewing machine as recited in claim 11, wherein:

the rotational counterweight is coupled to the driveshaft with the driveshaft positioned between a higher mass portion of the rotational counterweight and a lower mass portion of the rotational counterweight; and the reciprocating counterweight is coupled to the lower mass portion of the rotational counterweight.

* * * * *